United States Patent [19]

Ferns

[11] Patent Number: 4,549,833

[45] Date of Patent: Oct. 29, 1985

[54] FRAME MEMBERS FOR SUPPORTING COVERS OR GRATINGS

[75] Inventor: Derek Ferns, Trelleck, Wales

[73] Assignee: Selflevel Covers (Jersey) Limited, Jersey, Channel Islands

[21] Appl. No.: 440,435

[22] Filed: Nov. 9, 1982

[30] Foreign Application Priority Data

Nov. 10, 1981 [GB] United Kingdom ..... 8133879

[51] Int. Cl.[4] ..... E02D 29/14

[52] U.S. Cl. ..... 404/4; 404/25; 52/20

[58] Field of Search ..... 404/25, 26, 2, 4, 5; 52/19–21; 210/163, 164; 248/314

[56] References Cited

U.S. PATENT DOCUMENTS

| | | | |
|---|---|---|---|
| 1,360,630 | 11/1920 | Fairtrace | 210/164 |
| 1,447,256 | 3/1923 | Lincoln | 404/26 |
| 2,305,955 | 12/1942 | Dudley | 210/163 X |
| 2,997,932 | 8/1961 | Taylor | 404/26 |
| 3,975,870 | 8/1976 | Naka | 404/25 X |
| 3,999,335 | 12/1976 | Nagy et al. | 404/25 X |
| 4,123,184 | 10/1978 | Whitlock | 404/25 |
| 4,174,183 | 11/1979 | Ferns | 404/26 |

FOREIGN PATENT DOCUMENTS

| | | | |
|---|---|---|---|
| 103610 | 4/1938 | Australia | 404/25 |
| 404565 | 7/1965 | Switzerland | 404/25 |
| 2013301 | 8/1979 | United Kingdom | 52/19 |

*Primary Examiner*—James A. Leppink
*Assistant Examiner*—Beverly E. Hjorth
*Attorney, Agent, or Firm*—Young & Thompson

[57] ABSTRACT

In order to ensure that a manhole/inspection cover or grating is firmly seated in a road or other surface within which it is installed and is substantially non-rocking, it is supported on opposite sides by two frame members each of which comprises two seating blocks joined together by an elongate bar. The seating blocks have angled seating faces which are inclined downwardly towards each other and which are engaged by correspondingly inclined angled faces on the cover or grating. Furthermore the bar is provided with an additional angled seating face which is inclined in a direction transverse to the longitudinal axis of the bar and is engaged by one or more correspondingly inclined angled faces on the cover or grating. Optionally the or each frame member is double-sided, that is it incorporates a respective additional angled seating face on each side of the bar, so as to support two covers or gratings in side-by side relationship.

7 Claims, 3 Drawing Figures

FRAME MEMBERS FOR SUPPORTING COVERS OR GRATINGS

BACKGROUND OF THE INVENTION

This invention relates to frame members for supporting manhole/inspection covers or gratings.

In order to ensure that a manhole/inspection cover or grating is firmly seated in the road or other surface within which it is installed and is substantially non-rocking, it is known to fit the cover or grating within a frame having angled seating faces which are inclined downwardly towards each other, and to provide correspondingly inclined faces on the cover or grating for engaging these angled seating faces. The frame may comprise two or more frame members each of which comprises two seating blocks defining angled seating faces downwardly inclined towards each other and an elongate frame bar connecting the blocks together. However, the cover or grating may be subjected to high loading, particularly in heavy traffic areas, and this arrangement suffers from the disadvantage that all the load is taken by the seating faces on the seating blocks.

It is an object of the invention to obviate this disadvantage by distributing the load more evenly along the frame member.

SUMMARY OF THE INVENTION

According to the invention a frame member for supporting a cover or grating comprises two seating blocks joined together by an elongate frame bar, the two seating blocks having angled seating faces inclined downwardly towards each other and the frame bar providing an additional angled seating face extending along at least part of the length of the bar and inclined in a direction transverse to the longitudinal axis of the bar and inwardly with respect to the intended position of the cover or grating.

Preferably the additional angled seating face extends along substantially the whole length of the bar. The cover or grating is provided with one or more correspondingly inclined faces for engaging the additional angled seating face at the same time as other inclined faces on the cover or grating engage the angled seating faces on the seating blocks. The additional angled seating face therefore contributes to the support of the load, and this therefore enables the cover or grating to withstand heavier loading.

In a preferred form of the invention the angled seating faces on the seating blocks extend from the level of the upper surface of the frame member to an intermediate level, and the additional angled seating face extends from the intermediate level to the level of the lower surface of the frame member. Such a frame member is conveniently cast by the mono block process, i.e. in one piece, from spheroidal graphite iron. This enables the frame member to be cast to very high tolerances so that an accurate fit with the matching cover or grating (also preferably made from spheroidal graphite iron) is ensured.

In order to allow the frame member to support parts of two adjacent covers or gratings, two angled seating surfaces may be provided on opposite sides of the frame bar and inclined in opposite directions for engaging correspondingly inclined faces on the adjacent covers or gratings, respectively. Such a double-sided frame bar is particularly useful where the frame member is to be supported on a beam, particularly an I-section beam, spanning an access pit or manhole as it ensures that eccentric loading of the beam does not occur under heavy loading conditions.

The invention also includes within its scope a manhole/inspection cover or grating for use with one or more frame members according to the invention and provided with inclined faces for engaging the angled seating faces on the or each frame member. More than one inclined face may be provided on the cover or grating for engaging the additional angled seating face on the frame bar of the or each frame member, or alternatively a single inclined face may be provided which preferably engages the additional angled seating face over substantially its complete length for distributing the load along the length of the bar.

BRIEF DESCRIPTION OF THE DRAWINGS

In order that the invention may be more fully understood, two installations in accordance with the invention will now be described, by way of example, with reference to the accompanying drawings, in which.

DETAILED DESCRIPTION OF THE DRAWINGS

Figure 1:
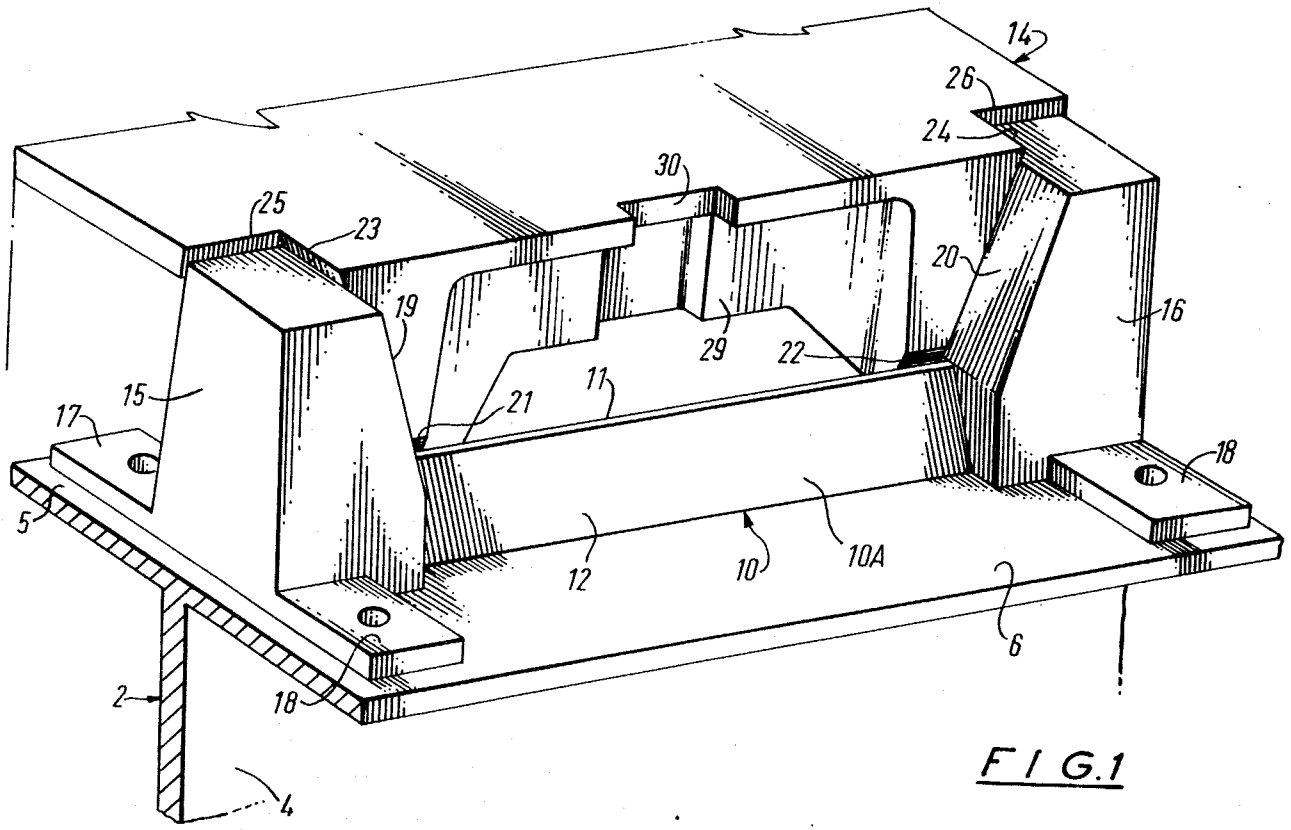
FIG. 1 is a perspective view of a frame member and cover on a support beam in a first installation.
Figure 2:
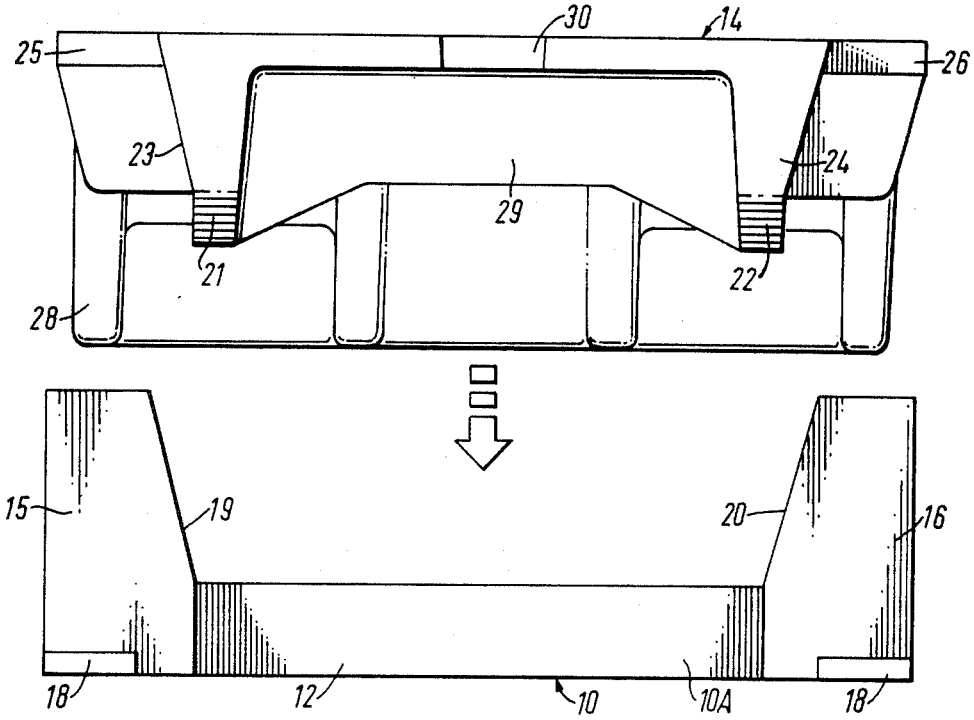
FIG. 2 is a view of the frame member and cover of FIG. 1 from one side, prior to fitting of the cover.

Referring to FIG. 1 the support beam 2 is a rolled steel joist (RSJ) of I-section and includes a central support web 4, upper flanges 5 and 6 and lower flanges (not shown). Referring also to FIG. 2, the frame member 10 includes a frame bar 10A having two inclined seating faces 11 and 12 each of which is provided for supporting a respective one of two adjacent covers such as 14. The frame member 10 also includes at its ends two seating blocks 15 and 16 each of which is provided with two flanges 17 and 18 which are attached to the support beam 2 by bolts (not shown). The seating blocks 15 and 16 have angled seating faces 19 and 20 each of which provides support for both of the adjacent covers such as 14.

The covers are shaped so that, when they are engaged with the frame member 10, the edges of the covers are substantially contiguous. Each cover is provided with inclined faces 21 and 22 for engaging with one of the inclined seating faces 11 or 12 on the frame member 10. The cover 14 is shown slightly raised in FIG. 1 so that these faces 21 and 22 are visible. In addition each cover is provided with angled faces 23 and 24 for engaging with the angled seating faces 19 and 20 on the seating blocks 15 and 16 of the frame member 10. Both covers also incorporate re-entrant corners 25 and 26 for accommodating the seating blocks 15 and 16, numerous strengthening ribs such as 28 and 29, and a recess 30 for enabling the cover to be lifted.

Where a pit or manhole having a clear opening of relatively large area is to be covered by such an arrangement, the opening is spanned by a number of support beams arranged parallel to one another and spaced apart by a distance corresponding to the lengths of the covers. Frame members such as 10 for supporting the covers are then laid end to end along the beams and bolted to the beams. Finally the covers are disposed side by side in rows between the beams so that each cover is supported by a respective frame member at each of its ends and adjacent covers in the same row abut each other along their sides. Adjacent covers in adjacent rows are both supported by the same double-sided frame member.

Figure 3:
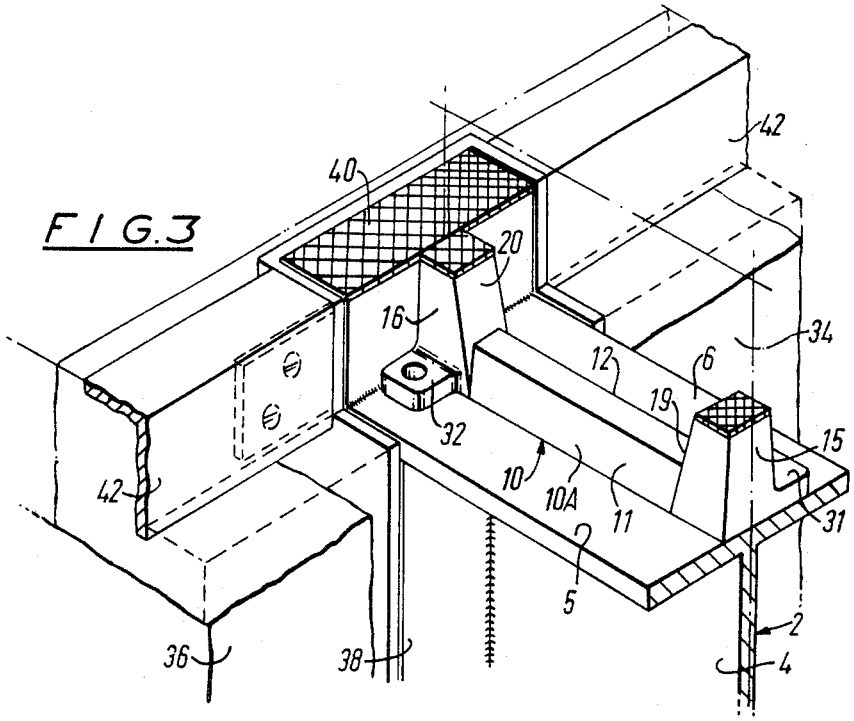
FIG. 3 is a perspective view of a frame member on a support beam in a second installation.

In the installation shown in FIG. 3 the frame member 10 is slightly different in construction from the frame member of FIGS. 1 and 2. In particular each seating block 15 or 16 is provided with only a single flange 31 or 32, and the flange 31 on the seating block 15 extends from one side of the frame member 10 whilst the flange 32 on the seating block 16 extends from the other side of the frame member 10. The frame member 10 is fixed to the support beam 2 by means of bolts (not shown) passing through the flanges 31 and 32 so that its longitudinal axis lies directly above the centre line of the beam 2 and in particular so that the longitudinal axis of the frame member 10 lies in a vertical plane 34 within which the support web 4 of the beam 2 extends.

The support beam 2 spans the clear opening of a pit 36 and is welded at each end to a thick stiffening plate 38 and a wall box 40 fixed to the side of the pit 36. In addition angle side frame members 42 are attached to the edges of the pit 36 for locating the sides of the covers closest to the sides of the pit.

I claim:

1. A frame member for supporting two adjacent covers or gratings, comprising two seating blocks, an elongate frame bar, joining the seating blocks, angled seating faces on the respective seating blocks and said faces being inclined downwardly towards each other, and additional angled seating faces extending along at least part of both sides of the length of the bar and inclined in opposite directions and diverging downwardly, the first-mentioned angled seating face on each seating block supporting both said covers or gratings with their edges contiguous, said additional angled seating faces each supporting a different one of said covers or gratings.

2. A frame member according to claim 1, wherein the additional angled seating faces extend along substantially the whole length of the bar.

3. A frame member according to claim 1, wherein the angled seating faces on the seating blocks extend from the level of the upper surface of the frame member to an intermediate level, and the additional angled seating faces extend from the intermediate level to the level of the lower surface of the frame member.

4. A frame member according to claim 1, wherein the seating blocks and said frame bar are made as a one piece casting.

5. A frame member according to claim 1, wherein each seating block is integrally formed with one or more flanges for supporting the frame member on a flat surface.

6. A manhole/inspection cover or grating for use with one or more frame members according to claim 1, wherein the cover or grating is provided with inclined faces for engaging the angled seating faces on the or each frame member.

7. A cover or grating according to claim 6, wherein more than one inclined face is provided on the cover or grating for engaging the additional angled seating face on the frame bar of the or each frame member.

* * * * *